United States Patent [19]

Dola et al.

[11] Patent Number: 4,762,500

[45] Date of Patent: Aug. 9, 1988

[54] IMPEDANCE MATCHED ELECTRICAL CONNECTOR

[75] Inventors: Frank P. Dola, Hudson; Steven Feldman, Seminole, both of Fla.

[73] Assignee: AMP Incorporated, Harrisburg, Pa.

[21] Appl. No.: 937,797

[22] Filed: Dec. 4, 1986

[51] Int. Cl.[4] ..... H01R 9/09

[52] U.S. Cl. ..... 439/79; 439/83; 439/101

[58] Field of Search ..... 339/14 R, 17 R, 17 C, 339/17 LM, 17 M, 17 CF, 143 R, 125 R, 126 R, 131; 361/407; 357/81; 439/79-83, 101, 108

[56] References Cited

U.S. PATENT DOCUMENTS

| | | | |
|---|---|---|---|
| 3,434,094 | 3/1969 | Walter | 339/17 |
| 3,448,345 | 6/1969 | Koehler et al. | 361/407 |
| 3,634,814 | 1/1972 | Inacher | 339/176 MP |
| 3,643,201 | 2/1972 | Harwood | 339/17 R |
| 3,651,432 | 3/1972 | Henschen et al. | 333/33 |
| 3,689,865 | 9/1972 | Pierini et al. | 339/17 L |
| 3,871,728 | 3/1975 | Goodman | 339/14 R |
| 3,902,777 | 9/1975 | Anhalt et al. | 339/17 C |
| 3,984,166 | 10/1976 | Hutchison | 339/17 CF |
| 4,133,592 | 1/1979 | Cobaugh et al. | 339/17 M |
| 4,331,370 | 5/1982 | Andrews et al. | 339/17 M |
| 4,386,814 | 6/1983 | Asick | 439/607 |
| 4,403,102 | 9/1983 | Jordan et al. | 174/16 HS |
| 4,406,512 | 9/1983 | Schell | 439/497 |
| 4,418,972 | 12/1983 | Benasutti | 339/14 R |
| 4,433,886 | 2/1984 | Cassarly et al. | 339/14 R |
| 4,582,386 | 4/1986 | Martens | 339/19 |
| 4,601,527 | 7/1986 | Lemke | 439/81 |
| 4,602,831 | 7/1986 | Lockard | 439/108 |
| 4,616,893 | 10/1986 | Feldman | 339/14 R |
| 4,655,518 | 4/1987 | Johnson et al. | 339/14 R |
| 4,695,106 | 9/1987 | Feldman et al. | 439/83 |

FOREIGN PATENT DOCUMENTS

| | | |
|---|---|---|
| 2517482 | 6/1983 | France . |
| 8700741 | 4/1987 | PCT Int'l Appl. . |

OTHER PUBLICATIONS

Teradyne Technical Bulletin 237 (issue date 1-29-85).

*Primary Examiner*—Neil Abrams
*Attorney, Agent, or Firm*—Robert W. Pitts

[57] ABSTRACT

A connector formed of mating connector halves for interconnecting corresponding conductive traces of opposed printed circuit boards. Each connector half is formed of an insulative housing with electrical elements. The electrical elements include terminals of separable signal contacts arranged in rows and a central blade-like bus functioning as a reference ground plane or as a power member. When the connector halves are mechanically joined, they will electrically interconnect conductive traces of one printed circuit board with conductive traces of the other printed circuit board.

16 Claims, 8 Drawing Sheets

86
90
32
86
94
58
48
64
66
70
54
42
92
79
46
94
14
42
20
128
138
96
130
54
130
136
56
58
26
138
150
132
138
134
138
96
138
96

IMPEDANCE MATCHED ELECTRICAL CONNECTOR

FIELD OF THE INVENTION

The present invention relates generally to an electrical connector and, more particularly, to a printed circuit board connector with controlled characteristic impedance.

BACKGROUND OF THE INVENTION

Modern electronic systems require that signals be transmitted with ever-increasing speed and low error rates. This necessitates a transmisson line and associated interconnections between a signal source, such as a transmitter or line driver, and a load, such as a receiver, which match the characteristic impedance of the signal source and load while exhibiting low loss or attenuation.

To effect these results it has been found necessary to utilize transmission line techniques designed for the particular application. Printed circuit boards had previously been manufactured with no particular attention to the impedance characteristics, i.e., dynamic resistance, of the signal carrying conductors. Such circuit boards are generally now being constructed with all the structural and functional characteristics of transmission lines, with signal carrying conductors placed at a known preestablished distance from a reference plane and separated from the reference plane by insulation of known, preestablished electrical characteristics. While printed circuit boards themselves are being designed and fabricated today with attention to the desired transmission line characteristics, unless the entire electrical package or system is provided with the desired transmission line characteristics, including connectors between the circuit boards, the overall system is degraded and unable to achieve an operating performance with the desired accuracy and speed.

Types of transmission lines for use in transmitting electrical signals, whether in circuit boards or in connectors, include microstrip, stripline and coax. Microstrip geometry is characterized by a reference or ground plane on one side only of, and parallel with, the signal carrying conductors. Stripline geometry is similar to microstrip but employs two parallel reference or ground planes with the signal carrying conductors parallel to one another and between the ground planes. The third transmission geometry, coax, is characterized by the signal carrying conductors being individually surrounded by the reference or ground plane.

One arrangement for providing coaxial cable transmission line connections between printed circuit boards is disclosed in U.S. Pat. No. 3,689,865 to Pierini. While satisfactory from a technical standpoint, this arrangement is less than desirable when constructing high density electrical connectors because such an arrangement for circuit board connection is bulky and reduces the density of the interconnections to an undesirably low level.

Other types of printed circuit board connectors designed to maintain the circuit transmission line impedance characteristics are disclosed in U.S. Pat. Nos. 4,418,972 to Benasutti; 3,651,432 to Henschen; 3,643,201 to Harwood; 4,133,592 to Cobaugh; and 3,871,728 to Goodman as well as Technical Bulletin Number 237 to Teradyne. While these connectors constitute improvements over the connectors employing discrete coaxial cables, such connectors are of limited utility due to less than optimum operational characteristics such as pin utilization inefficiencies.

By way of example, the apparatus disclosed in the Benasutti patent reduces impedance but does not control it. The Teradyne apparatus may inherently provide some impedance control for the exterior pin adjacent the ground plane but not for the remainder of the pins. The Henschen and Harwood patents require using every other signal pin to control impedance. The Goodman patent attempts to simulate coax. The Cobough patent gives no impedance control whatsoever. The prior art simply fails to teach connector geometry to allow microstrip transmission of electrical signals through connectors.

The present invention also constitutes an improvement over the printed circuit board connectors disclosed in commonly assigned U.S. Pat. No. 4,616,893 in the name of Feldman and U.S. patent application Ser. No. 733,176 filed May 13, 1985 in the name of Feldman et al.

As illustrated by the large number of prior patents and other disclosures, efforts are continuously being made in an attempt to efficiently, quickly, accurately and economically transmit electrical signals. None of these disclosures, however, suggests the present inventive combination of connector elements for transmitting electrical signals through the controlled characteristic impedance of microstrip transmission techniques as herein described and claimed. This invention achieves its purposes, objects and advantages over the prior art through new, useful and unobvious components which increase user convenience, consistently insure high data transmission rates with low error rates and effect a reduction in cost through the use of a minimum number of functioning parts. All this is attained through the utilization of only readily available materials and conventional components.

These purposes, objects and advantages should be construed as merely illustrative of some of the more prominent features and applications of the present invention. Many other beneficial results can be attained by applying the disclosed invention in a different manner or by modifying the invention within the scope of the disclosure. Accordingly, other objects and advantages as well as a fuller understanding of the invention may be had by referring to the summary of the invention and detailed description describing the preferred and alternate embodiments of the invention in addition to the scope of the invention as defined by the claims taken in conjunction with the accompanying drawings.

SUMMARY OF THE INVENTION

The present invention is defined by the appended claims with the specific embodments shown in the attached drawings. For the purposes of summarizing the invention, the invention may be incorporated into a controlled characteristic impedance electrical connector assembly for interconnecting corresponding conductive traces of printed circuit boards. The assembly comprises matable first and second insulative connector housings, each housing having a plurality of apertures extending between upper and lower faces and aligned in at least one row. The assembly also comprises a plurality of terminals formed of matable signal contacts with each aperture containing a signal contact and with each terminal having a mating portion and a printed circuit board trace engaging portion comprising a through-hole solder tail. Signal contacts in the first housing are matable with signal contacts in the second housing upon the mating of the housings. The assembly also comprises bus means including disconnectable first and second bus portions in the housings, the first and second bus portions being matable upon the mating of housings to form a continuous ground plane between the printed circuit boards. The mating portions of all terminals along the entire extent of their area of mating is effectively uniformly spaced from the bus means whereby a controlled characteristic impedance may be maintained between conductive traces of the printed circuit boards. Each housing is attachable to a printed circuit board by the bus portions and signal contacts. The printed circuit boards are interconnectable by the interconnection of the matable signal contacts and bus portions. The printed circuit boards may be interconnected by the connector assembly, one with respect to the other, in a parallel orientation. The printed circuit boards may be interconnected by the connector assembly, one with respect to the other, at an angle with respect to each other where the angle may be 90 degrees.

The invention may also be incorporated into an electrical connector for use in establishing interconnections to a printed circuit board. The connector includes a housing of insulative material having a plurality of terminal passages therein arranged in a planar array, the housing being formed of first and second matable portions. The connector also includes a plurality of electrical terminals with each mounted in a respective terminal passage and with each having a tail extending therefrom and constituting means for interconnection to a circuit of the printed circuit board. The terminals are formed of first and second matable portions. The connector further includes a rigid elongate bus within the housing, effectively parallel with the terminals and attachable to the printed circuit board for electrical connection to a reference plane. The bus is formed of first and second matable portions. One of the housing portions is formed of two blocks with means formed in at lesat one of the blocks to couple and uncouple the two blocks for the receipt of terminal portions and bus portions. The terminal portions and bus portions within the two blocks are configured for coupling printed circuit boards oriented in a non-parallel relationship with respect to each other. The electrical connector further includes aperture means in one of the blocks and projection means in the other of the blocks for being removably received within the aperture means to assist in the coupling and uncoupling of the blocks. The electrical connector yet further includes slot means in one of the blocks and additional means in the other of the blocks for being removably received within the slot means to assist in the coupling and uncoupling of the blocks.

The invention may further be incorporated into an electrical connector for use in establishing interconnections to a printed circuit board. The connector comprises a housing of insulative material having a plurality of passages therein arranged in a first plane. The connector further comprises a plurality of electrical terminals with each terminal mounted in a respective passage whereby each terminal is located within the first plane and with each terminal having a tail extending therefrom and constituting means for interconnection to a circuit of the printed circuit board. The connector further comprises a rigid, planar, elongate, electrically conductive ground bus mounted within a passage and located within a second plane effectively parallel with the first plane. The ground bus is attached to the housing effectively parallel with the terminals. The ground bus is also attachable to the printed circuit board for constituting a reference plane for the microstrip configured transmission of electric signals by the terminals. The connector yet further comprises bus solder tail means within the second plane formed as extensions of the ground bus and extending across the width of the ground bus and thus constitutes both the means for mounting the ground bus to the printed circuit board as well as the means for securing the housing to the printed circuit board. The ground bus is formed of a male and a female portion. Both the male and female portions of the ground bus are provided with a plurality of solder tails extending across the width of the ground bus. The female portion of the ground bus includes spring means biased for clasping the male portion of the ground bus. The spring means includes regions adapted for movement toward and away from the second plane. The spring means also includes other regions oriented and configured to secured the female portion of the ground bus within a passage of the housing.

In addition, the invention may be incorporated into an electrical connector for use in establishing interconnections between printed circuit boards. The connector comprises a housing of insulative material having a plurality of apertures therein arranged in a first plane. The connector also comprises a plurality of electrical terminals for establishing electrical couplings between the printed circuit boards with each electrical terminal being moutned in a respective aperture whereby each electrical terminal is located within the first plane and with each electrical terminal having tails extending therefrom and constituting means for interconnection to circuits of the printed circuit boards. The connector further comprises a rigid, planar, elongate, electrically conductive element attached to the housing in a second plane parallel with the first plane and electrical terminals. The electrically conductive element is attached between the printed circuit boards for constituting an additional means for establishing an electrical coupling between the printed circuit boards. The connector further comprises solder tails located within the second plane extending from edge to edge across the width of the electrically conductive element and constituting both the means for mounting the electrically conductive element to the printed circuit boards as well as the means for securing the housing to the printed circuit boards. The housing, electrical terminals, and electrically conductive element are each formed of matable male and female halves. The solder tails are formed on both halves of the electrically conductive element. The female half of the electrically conductive element includes springs biased for coupling with the male half of the electrically conductive element. The springs of the female half of the electrically conductive element are deformable into engagement with the male half of the electrically conductive element through movement generally perpendicular with respect to the axes of the electrical terminals. The electrical terminals are located in two spaced parallel planes on opposite sides of the second plane.

The invention may yet further be incorporated into an electrical connector for use in establishing an interconnection to a printed circuit board. The connector includes a housing of insulative material having passages therethrough and electrical terminals mounted in the passages and having means extending therefrom for interconnection to a circuit of the printed circuit board. The connector also includes a plurality of electrically conductive, separate busses mounted within the housing effectively parallel with the terminals. The connector also includes solder tails formed as extensions of the busses. The solder tails extend across the width of the busses for securing the housing and busses to the printed circuit board. The busses are each formed of mating male and female portions wherein at least one of the busses has a male portion of a length greater than the length of the male portion of another of the busses whereby mating of the bus portions will occur at different times for different busses. The bus with the portion of greater length is a ground bus and the bus with the male portion of lesser length is a power bus.

Further, the invention may be incorporated into an assembly for interconnecting corresponding conductive traces of printed circuit boards. The assembly comprises a first connector portion having a first housing formed of dielectric material with a plurality of first contacts retained within the first housing. The first contacts are positioned in two longitudinally extending parallel rows. Each first contact has a tail extending from an outwardly facing surface of the first housing. The assembly also comprises a second connector portion intermatable with the first connector portion and having a second housing formed of dielectric material with a plurality of second contacts retained in rows within the second housing and intermatable with the first contacts. Each second contact is configured to form an angle with respect to the first contact and has a tail extending from an outwardly facing surface of the second housing. The first and second housings are attachable to each other at their inwardly facing surfaces whereby the tails of the first and second contacts may be affixed to conductive traces of respective printed circuit boards. The assembly also comprises a ground plane means having a plurality of tails extending from edge to edge of the housing and positioned between the rows of contacts and configured to form an angle adjacent the rows of terminals of the second housing to thereby allow for the microstrip transmission of signals with controlled impedance characteristics between the printed circuit boards.

The invention may yet further be incorporated into an assembly for interconnecting corresponding conductive traces of printed circuit boards. The assembly includes a first connector half having a first housing formed of dielectric material with a plurality of first signal contacts retained within the first housing with the first signal contacts being positioned in two longitudinally extending parallel rows and with each first signal contact having a tail extending from an outwardly facing surface of the first housing. The assembly also includes a second connector half intermatable with the first connector half and having a second housing formed of dielectric material with a plurality of second signal contacts retained in rows within the second housing and intermatable with the first signal contacts. Each second signal contact is configured to form an angle with respect to the first signal contacts and also has a tail extending from an outwardly facing surface of the second housing. The first and second housings are attachable to each other at their inwardly facing surfaces whereby the tails of the first and second terminals may couple with the printed circuit boards for coupling conductive traces of respective printed circuit boards. The assembly also includes an electrical means within the housing and positioned between the rows of signal contacts and configured to form an angle whereby the terminals and electrical means are effectively electrically parallel between the printed circuit boards. The angle may be 90 degrees. The electrical means is provided with tails for electrically and mechanically coupling the assembly to the printed circuit boards.

Lastly, the invention may be incorporated into an electrical connector for use in establishing an interconnection to a printed circuit board. The connector includes a housing of insulative material having passages therethrough with electrical terminals mounted in the passages and with through-hole solder tails extending from the terminals for interconnection to the printed circuit board. The connector also includes at least one electrically conductive bus mounted in the housing effectively parallel with the terminals. Through-hole solder tails extend from the bus and constitute means for securing the housing and bus to the printed circuit board. The solder tails of the bus are longer than the solder tails of the terminals. The cross sectional configuration of the bus solder tails is greater than the cross sectional configuration of the terminal solder tails. The terminal solder tails and the bus solder tails may extend from two sides of the housing for interconnecting two circuit boards.

The foregoing has outlined rather broadly the more pertinent and important features of the present invention in order that the detailed description of the invention that follows may be better understood thereby the present contribution to the art may be more fuly appreciated. Additional features of the invention will be described hereinafter which form the subject of the claims of the present invention. It should be appreciated by those skilled in the art that the conception and the specific embodiments disclosed herein may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

In the accompanying drawings:

FIG. 3 is an exploded perspective view of the second or female connector portion shown in alignment with the female signal contacts and the female bus portions.

FIG. 8 is a schematic illustration of one example of a current flow path through the apparatus of both embodiments of the present invention when the bus contacts are connected to a common ground.

DETAILED DESCRIPTION OF THE PREFERRED EMBODIMENTS

Figure 4:
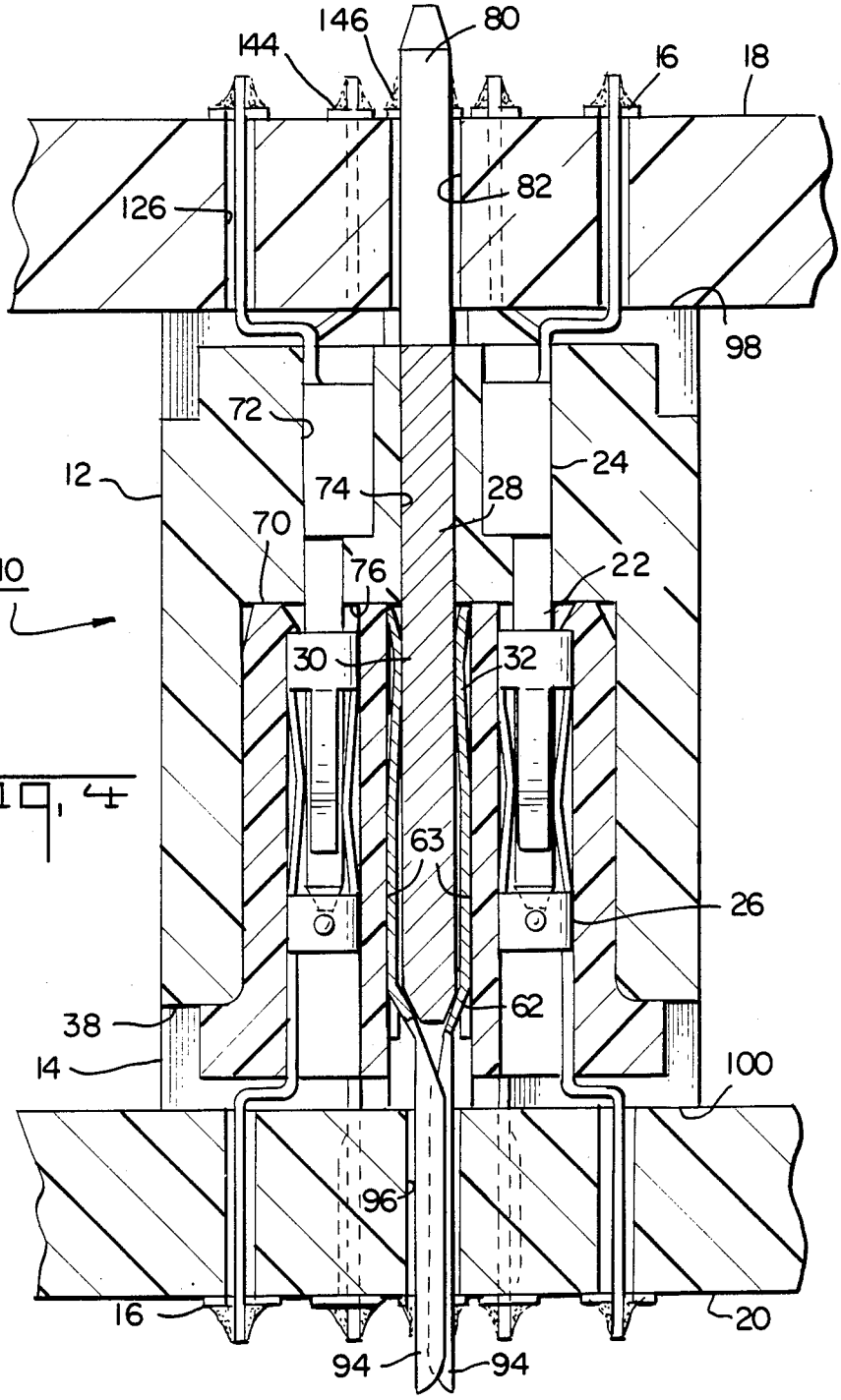
FIG. 4 is a sectional view showing the interconnection between the connector portions and their electrical components shown in FIGS. 1, 2 and 3 to establish an electrical and mechanical coupling between printed circuit boards which are disposed in parallel relationship.

Each disclosed embodiment of the present invention constitutes a system, shown in FIG. 4, as comprised of a connector 10, formed as an assembly of mating connector halves or portions 12 and 14, interconnecting corresponding conductive traces 16 of related printed circuit boards 18 and 20. Each half is adapted to be mounted on a printed circuit board or the like. When the halves are mechanically joined, they will electrically and mechanically couple the conductive traces 16 of one printed circuit board 18 with the conductive traces 16 of the associated printed circuit board 20 and thus provide electrical continuity between the circuit boards.

Figure 1:
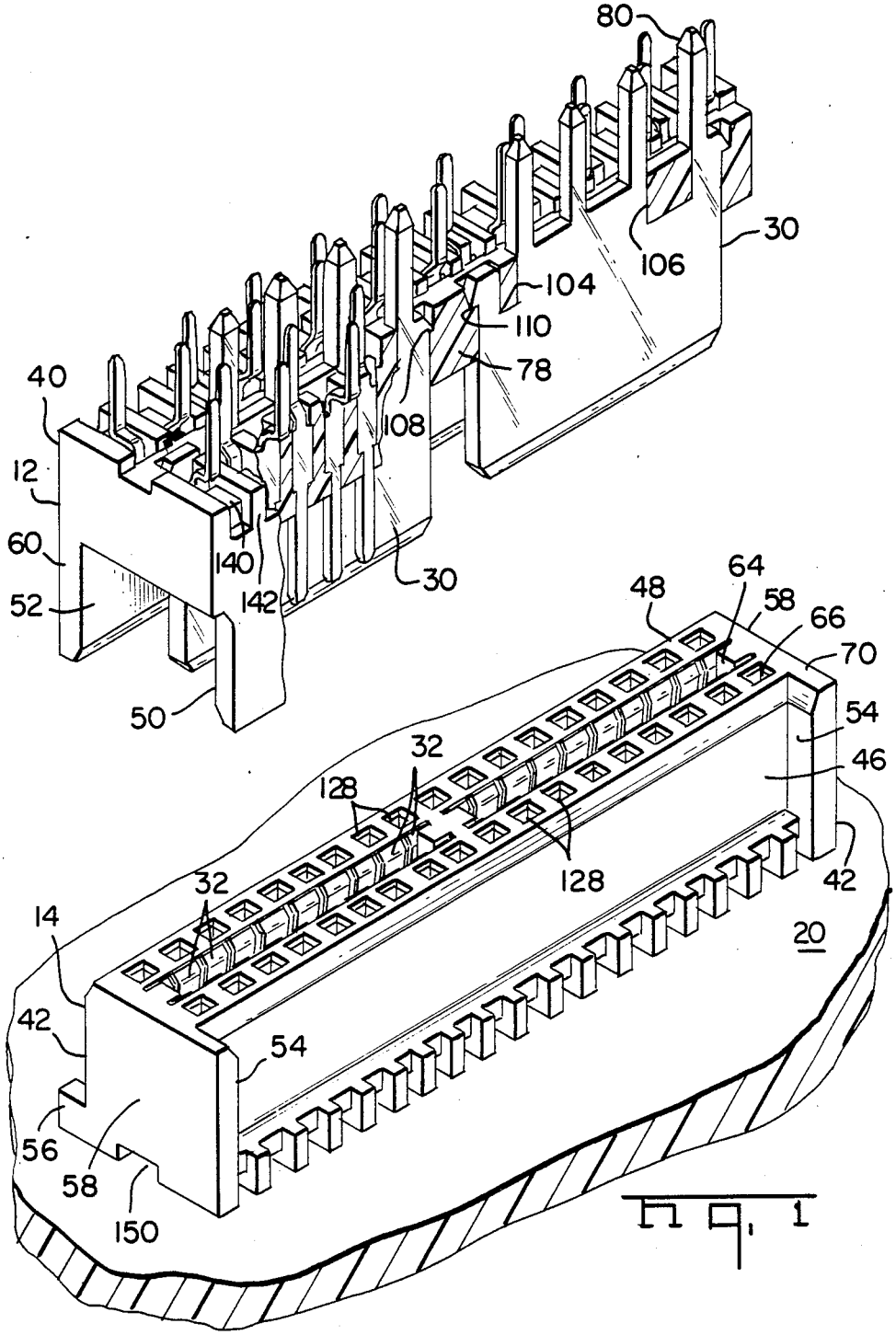
FIG. 1 is an exploded perspective view of a first or male connector portion, to which the male bus portions and the male signal contacts are coupled, shown in alignment with a second or female connector portion, to which the female bus portions and the female signal contacts are coupled.

The preferred embodiment of the present invention is depicted as a connector 10, shown in FIGS. 1 and 4. The connector is employed to interconnect circuits of printed circuit boards disposed in a spaced parallel relationship. Note FIG. 4. One or more of the connectors may be mounted between adjacent printed circuit boards in such a manner that each male connector half or portion 12, shown in the preferred embodiment as the upper half, may be mated, mechanically as well as electrically, with an associated female connector half 14, shown in the preferred embodiment as the lower half. As used herein, the terms upper and lower are merely used for descriptive purposes to facilitate an understanding of the disclosed embodiments. It should be understood that the invention is intended to encompass connectors oriented upside down or at any other angular orientation since the male and female portions of the connector could just as easily be utilized in any such alternate orientations. As can be seen, particularly in FIG. 4, each connector includes a plurality of terminals 22, each constructed of two mating signal contacts 24 and 26; one or more current carrying planar, blade-like busses 28, each constructed of two mating portions 30 and 32; and a housing 38 for supporting the terminals and the bus or busses. The housing assembly is also constructed of two mating housing halves or portions 40 and 42.

The portions 40 and 42 of the housing 38 are preferably molded or otherwise formed of an electrically insulating material such as any of the known plastics utilized for such purposes. The exterior front and back faces 46 and 48 of the lower housing portion 42 are of such size and configuration as to be received by the interior front and back surfaces 50 and 52. of the upper housing portion 40 when coupled for operation and use. Ledges 54 and 56 extend forwardly and rearwardly from the edges 58 of the lower housing portion 42 to contact the edges 60 of the upper housing portion 40 and thereby assist in aligning the housing portions and in limiting the movement of the housing portions transversely with respect to each other. This relationship, along with the entry of male electrical components, downwardly extending from the male connector half 12 into the upwardly disposed openings of the female connector half 14, will assure proper coupling of the two connector halves. More specifically, initially alignment of the connector halves is effected by the male portions 30 of the busses entering the upper regions of the female portions 32 of the busses which are forced outwardly toward the adjacent fixed regions of the housing halves in which they are located. The lower edges 62 of the female portions 32 of the busses normally bear against the adjacent edges 63 of the lower housing portion 42 to effect proper positioning of the female portions of the busses in the housing slot 64.

The lower housing portion 42 includes an elongated slot or slots 64 and small parallel cavities or apertures 66 at its upper or interior mating face 70. The slots are merely elongated apertures. The upper housing portion 40 includes corresponding cavities or apertures 72 and an elongated slot or slots 74 in its lower or interior mating face 76. When the housing halves are joined, the apertures 66 and 72 of the housing halves are axially aligned in spaced parallel planes, so that they are adapted to removably receive a plurality of pin and socket type electrical terminals. Similarly, the elongated slots 64 and 74 of the housing halves align when the housing halves are joined. They are adapted to receive a bus or busses 28 in a plane between the planes formed by the apertures 66 and 72. The apertures extend completely through the housing halves but are of varying sizes forming steps along their lengths to accommodate the shape of the signal contacts 24 and 26 of the terminals 22. The slots become formed as a plurality of smaller slots adjacent the exterior faces 98 and 100 to accommodate the shapes of the bus portions. Spacers 78 and 79 constitute spacers to isolate adjacent busses. Additional spacers 104 and 106 limit the movement of the upper bus portions into the upper housing half and, being of different widths, ensure proper orientation of the bus portions.

The busses 28 are plate-like members which, like the housing 38 and the terminals 22, are formed of two portions 30 and 32, upper and lower, matable adjacent interior faces 70 and 76 of the housing, the interface of the connector halves. In the preferred embodiment, each bus is electrically conductive and may function as an electrical ground or reference plane. As will be described hereinafter, any of the busses may also function as a power bus. The bus or busses may extend for any distance across the width of the connector within the housings. A single bus may be employed or, as shown in the preferred and alternate embodiments, the bus may be formed of a plurality of smaller bussses, each of which functions in the intended manner or manners as will be later described.

Each upper or male bus portion 30 is formed of a planar, relatively rigid, electrically conductive material positionable into the longitudinal slot 74 in the center of the upper housing portion 40, spaced from, and located between, the rows of terminals 22 and parallel therewith. Upwardly extending from the busses are upper retention posts or solder tails 80 extending through the slots 74 in the housing and holes 82 in the printed circuit board. Solder tails 80 may be chamfered along their lengths to increase the area of contact with the holes 82 for improved performance. The lower or female bus portion 32 is formed of a pair of opposed plates 86 formed at their upper ends as springs 90 and 92 located in the longitudinal slot 64 in the center of the lower housing. Springs 90 and 92 are resiliently biased to clasp the male portion 30 of the bus. The springs 90 and 92 are urged inwardly perpendicular to the axes of the terminals. The coupling of the bus halves is for mechanical attachment as well as for electrical coupling between the printed circuit boards. At their lower ends, the busses are formed with rows of downwardly extending lower retention posts or solder tails 94 spaced from, and parallel with, the terminals. These posts are formed by nested or mating J-shaped extensions of the lower female bus portions. The shorter legs of each extension are located in the bight of the associated extension to form the posts or solder tails. The solder tails 94 extend outwardly from the slots 64 in the housing and holes 96 in the printed circuit board 20. The slots in the two housings are of a size and location to align the bus portions when the housing halves are joined.

Adjacent the exterior face 98 of the housing, the slots become smaller for the passage of the posts but not the other parts of the busses. Shallow blocks 104 and 106 of different widths, as can be seen in FIG. 1, ensure proper positioning of the bus halves within the housing slots and preclude reverse insertion, and also to constitute ledges for ensuring the insertion of the blades to a proper depth. Deep blocks or spacers 78 separate and electrically isolate the upper portions of adjacent busses within a common lower housing portion. Similarly, blocks 79 separate and electrically isolate the lower portions of adjacent busses within a common housing portion. The deep blocks are formed with corner shoulders 108 adjacent their exterior edges for receiving outwardly extending ledges 110 at corners of the busses. This arrangement prevents inadvertent removal of the busses from the housings.

Each of the electrical terminals 22 comprises a male and a female signal contact 24 and 26, each contact being preferably stamped or othewise formed for their receipt within the apertures 66 and 72 of the housing halves whereby, when mated, they may form current carrying electrical terminals. They are each located parallel with, adjacent to, and spaced from, the electrically conductive busses 28, when mated. The signal contacts, being located within the apertures, are thus insulated from the busses by the electrically insulative plastic material of which the housings are preferably formed. The terminals are precisely positioned relative to the busses whereby the bus may comprise a means for controlling the characteristic impedance of signals carried by the terminal. The busses also constitute a return path for the current employed in powering the electrical system defined by the connectors and the printed circuit boards which they couple.

Figure 2:
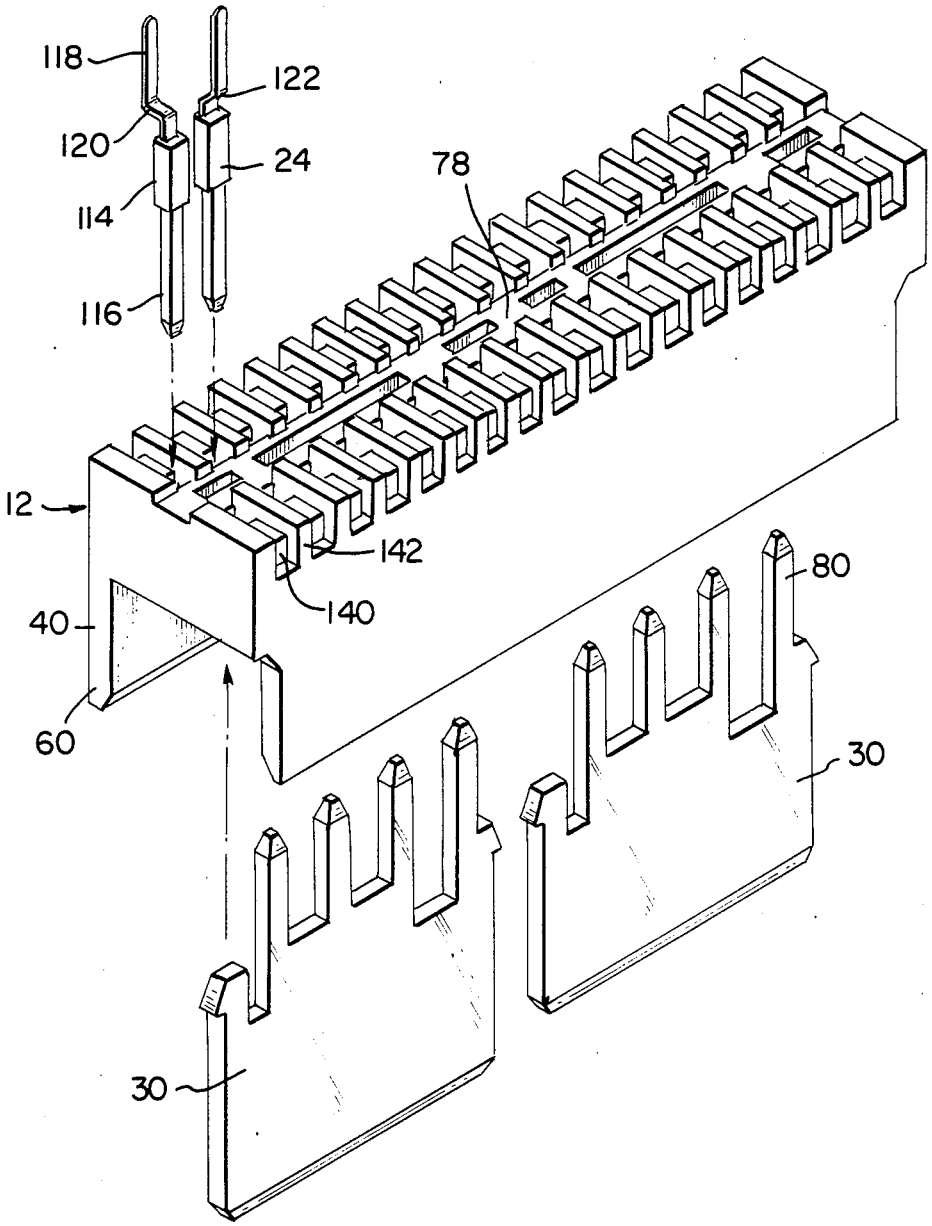
FIG. 2 is an exploded perspective view of the first or male connector portion shown in alignment with the male bus portions and the male signal contacts.

With reference to FIGS. 2 and 4, the male signal contact 24 of each terminal is formed with a central section 114 with a rectangular cross section and a downwardly extending free end or pin 116 for being received by the upper section of the female portion of the signal contact 26. The downwardly extending free end or pin 116 is of a rectangular cross section smaller than the central section 114 of the male portion. The upper end of the male signal contact is formed with an integral tail 118 for coupling with a trace 16 of the printed circuit board. Alternate upwardly extending tails are bent generally horizontally outwardly and inwardly at 120 and 122 then upwardly so that the tails may couple with staggered parallel rows of through-holes 126, preferably plated, in the printed circuit board for electrically coupling with predetermined traces.

During the coupling of the mating connector halves, the pins 116 of the male portions of the terminals are in position to mate with corresponding receptacle terminals 128 of the female portions 26 of the terminals located normally to the interface of the mating interior faces 70 and 76 of the mating housing portions.

The details of the lower or female portion of the terminals are best shown in FIGS. 3 and 4. Each female portion of the terminals is fabricated of an electrical conductor, formed at its upper section as a box-like receptical connector or terminal 128 adapted to removably receive a pin-type terminal 116 depending as the lower portion of a male signal contact. Each pin receptacle includes resilient central beams 130 formed in a rectangular orientation. Each of the beams is arcuately formed and concave such that the center sections of beams extend laterally beyond the profile of the box terminal configuration for receiving a corresponding pin terminal between the beams for thereby releasably securing a pin of an associated male signal contact. When a male signal contact is inserted into a box terminal, the concave beams engage the flat sides of the inserted pin to form a secure and highly effective mechanical and electrical connection. Alternate downwardly extending tails 132 and 134 are bent horiontally outwardly at 136 then downwardly so that the tails may couple with through-holes 138 in staggered rows on the printed circuit board 20 for electrically coupling with predetermined traces 16.

Each of the signal contacts 24 and 26 has a flat, elongate solder tail 118, 132 and 134 which extends through and beyond an exterior face 98 and 100 of the housing assembly. Any of the known solder tail constructions may be utilized. Each solder tail comprises a flat bendable section shaped to extend into and through a hole 126 and 138 through the circuit board for contact with a predetermined electrical trace 16. Positioning of the signal contacts through the apertures in the housings provides a conductive path from adjacent the outwardly facing exterior surface 98 of one connector half to adjacent the opposite outwardly facing exterior surface 100 of the mating connector half and thus couples the appropriate traces of the associated printed circuit boards 18 and 20.

A plurality of laterally extending channels 140 are formed in the upper housing portions 40 on the outwardly facing surface 98 adjacent the printed circuit board 18. These channels are configured and positioned such that the alternate solder tails may be received and supported therein when the upper signal contacts 24 are inserted into the holes 72 of the upper housing portion 40. The channels function to separate each upper solder tail from each adjacent solder tail with the insulating material of the housings forming barriers 142 therebetween to isolate and provide separate electrical paths to and from the appropriate holes and traces of the adjacent printed circuit board.

Each terminal 22 has two solder tails, one on each end. FIGS. 1, 2 and 4 illustrate that the solder tail of opposite ends differ from each other only in the manner in which they may be configured for allowing them to be oriented through staggered parallel rows of holes in the printed circuit boards. It should also be appreciated that the through hole solder tails of the terminals, for one or both of the printed circuit boards, could be replaced by solder tails for other connection schemes such as surface mount connections.

The solder tails of the busses have a greater cross sectional configuration than the solder tails of the terminals. They also are longer and sturdier so that upon coupling a connector half to a printed circuit board, the bus solder tails enter their associated through-holes prior to the terminal solder tails for effecting an initial alignment between the terminal solder tails and their associated through-holes. Each of the solder tails is provided with a tapered portion at its free end to facilitate the entry of each solder tail into its associated through-hole.

As shown in the disclosed preferred embodiment, after the connectors have had their posts and tails inserted into holes of respective printed circuit boards, a solder connection can be made between each solder tail of the connectors and their corresponding holes in the printed circuit boards. The solder connection may be made by any of a variety of known techniques and may result in the formation of solder fillets 144 and 146 formed with the respective solder tails.

Fluid drains 150 may be formed as cutouts at the edges of the housings located at the bases of the housings adjacent the printed circuit boards. The drains allow fluids to drain away from the surfaces of the printed circuit boards as may be required as a result of certain types of soldering operations. The fluid drains may also constitute openings for viewing the state of completeness of the solder connections.

Figure 5:
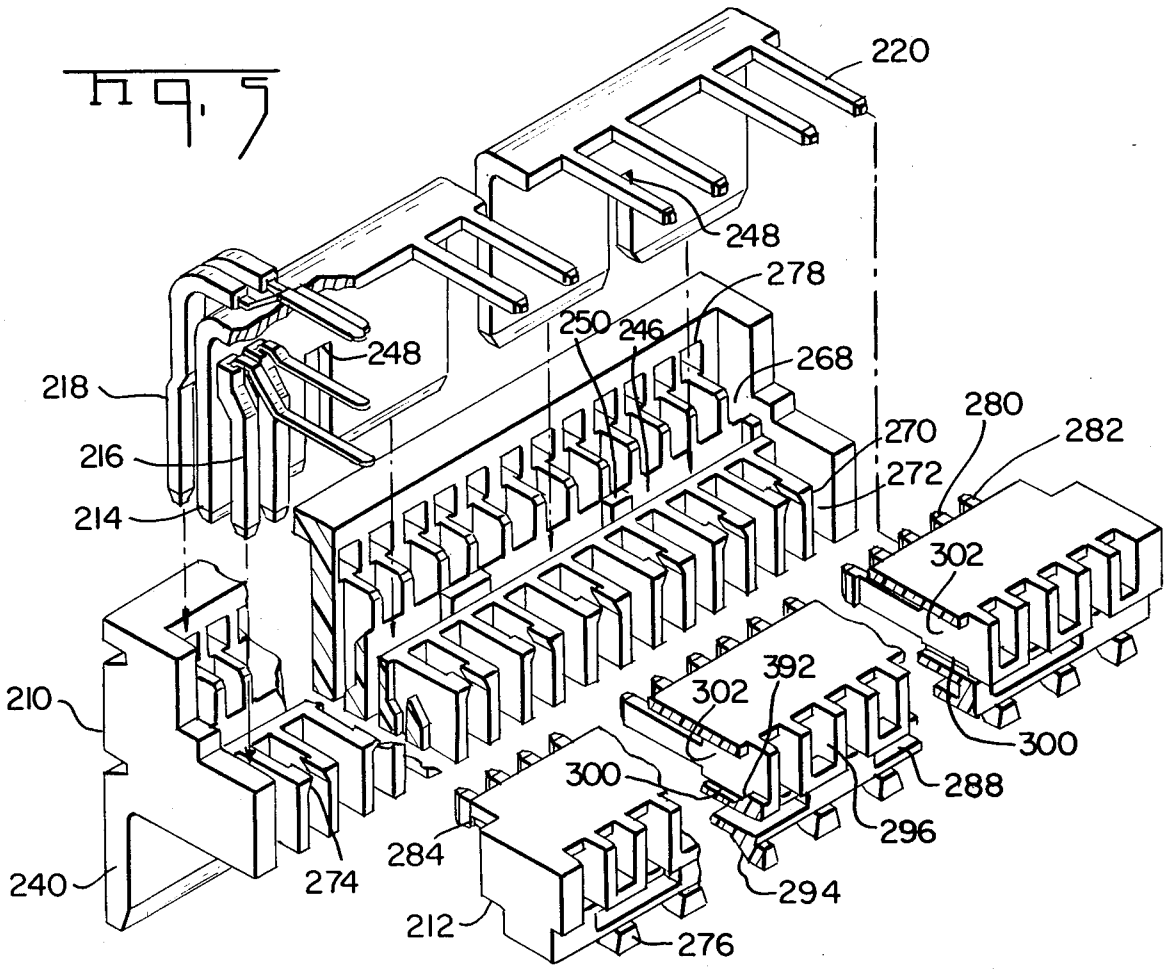
FIG. 5 is an exploded perspective view of the two parts of an upper connector housing shown in alignment with the male bus portions and the male signal contacts in accordance with an alternate embodiment of the invention designed for coupling printed circuit boards positioned at right angles with respect to each other.

The busses are preferably of discrete lengths, as shown in FIG. 2 for the primary embodiment and in FIG. 5 for the secondary embodiment. They are also arranged in a specific order which is also related to the lengths of the terminal portions whereby, upon coupling of the connector halves, those busses which function as grounds, would be the longest so that the ground bus portions would mate first and effect a current discharge. The next elements that mate would be the signal contacts which couple to form the terminals to set up all the control circuitry and biasing. Lastly, the bus portions, which function as power contacts, would couple to energize the circuit. This arrangement provides safety in the event that someone had power applied and then attempted to couple two connector halves together. Without such an arrangement, the circuit would malfunction because power would be provided to the circuit before all the signal contacts and grounds were established. Consequently, first the ground busses are preferably established, then the terminals and then power busses. Because of this preferred ordering, the reverse occurs when the boards and connector halves are unmated. The first elements to break are the power busses. The next to break are the terminals. Lastly, the ground busses break. Consequently, the ground busses always break last and there is little chance of harm by static electricity.

Figure 7:
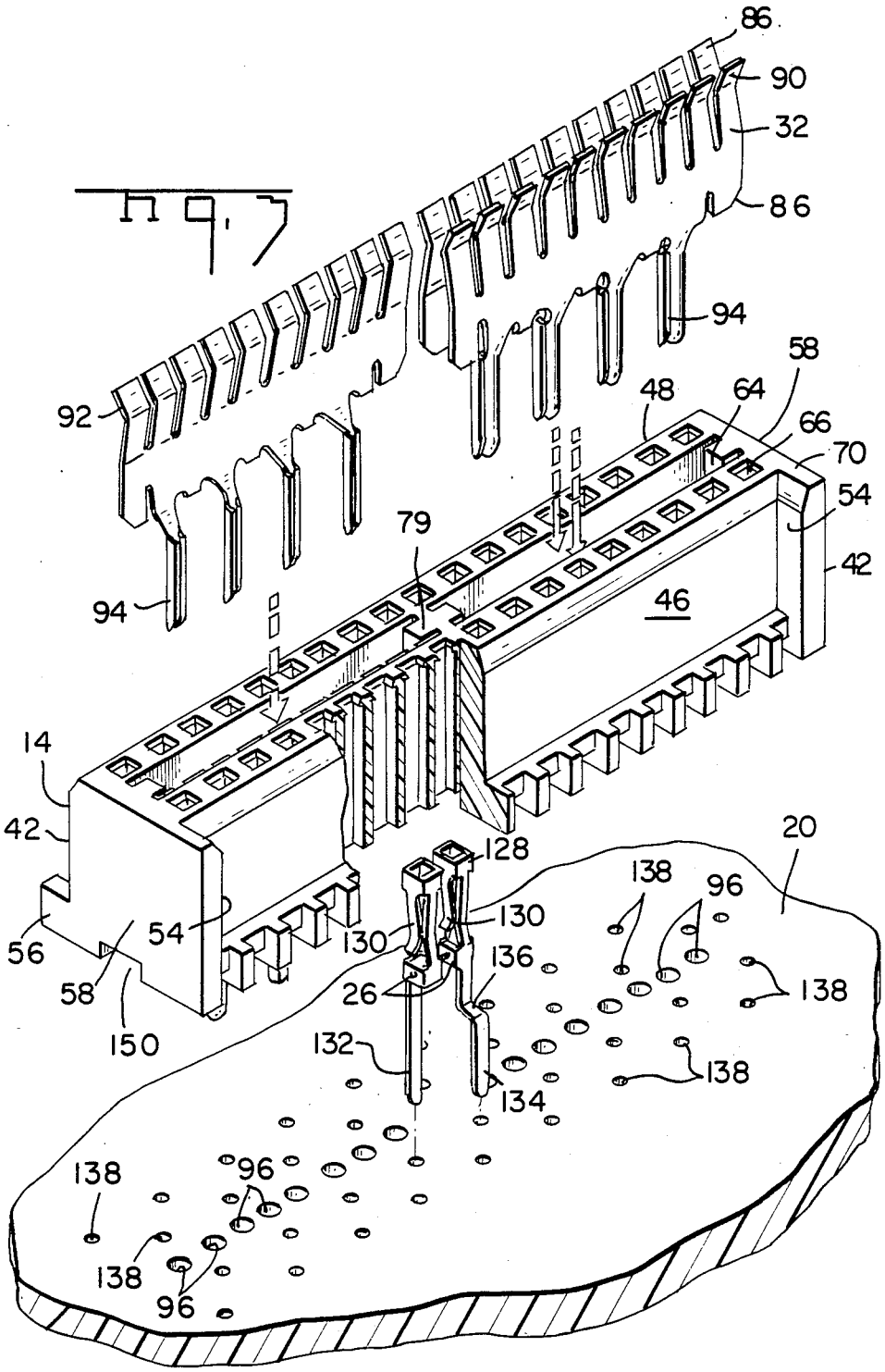
FIG. 7 is a sectional view showing the interconnection between the connector housings and their electrical components shown in FIGS. 5 and 6 to establish an electrical and mechanical coupling between the printed circuit boards.
Figure 6:
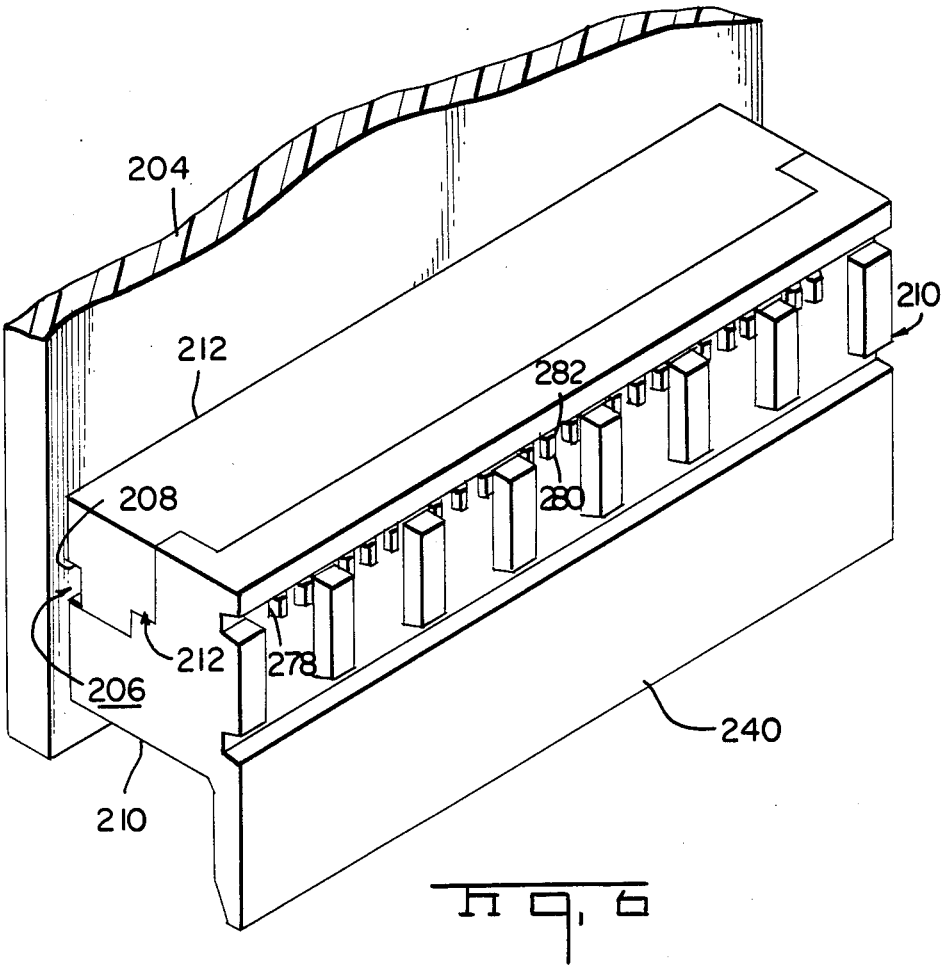
FIG. 6 is a perspective view of the two parts of the upper connector housing shown in FIG. 5 but with the parts coupled and as seen from the side opposite from the showing of FIG. 5.
Figure 7:
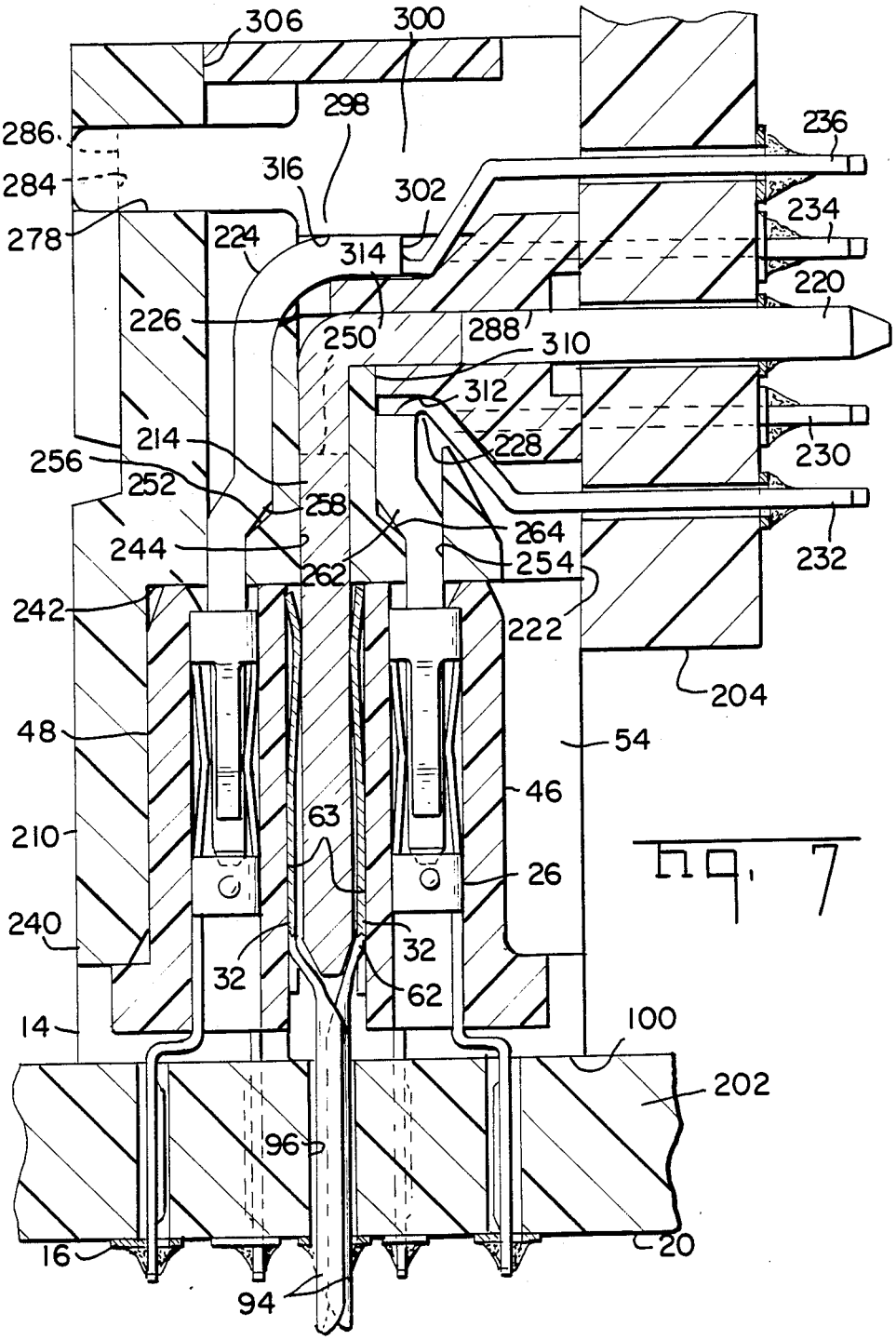
Figure 1:
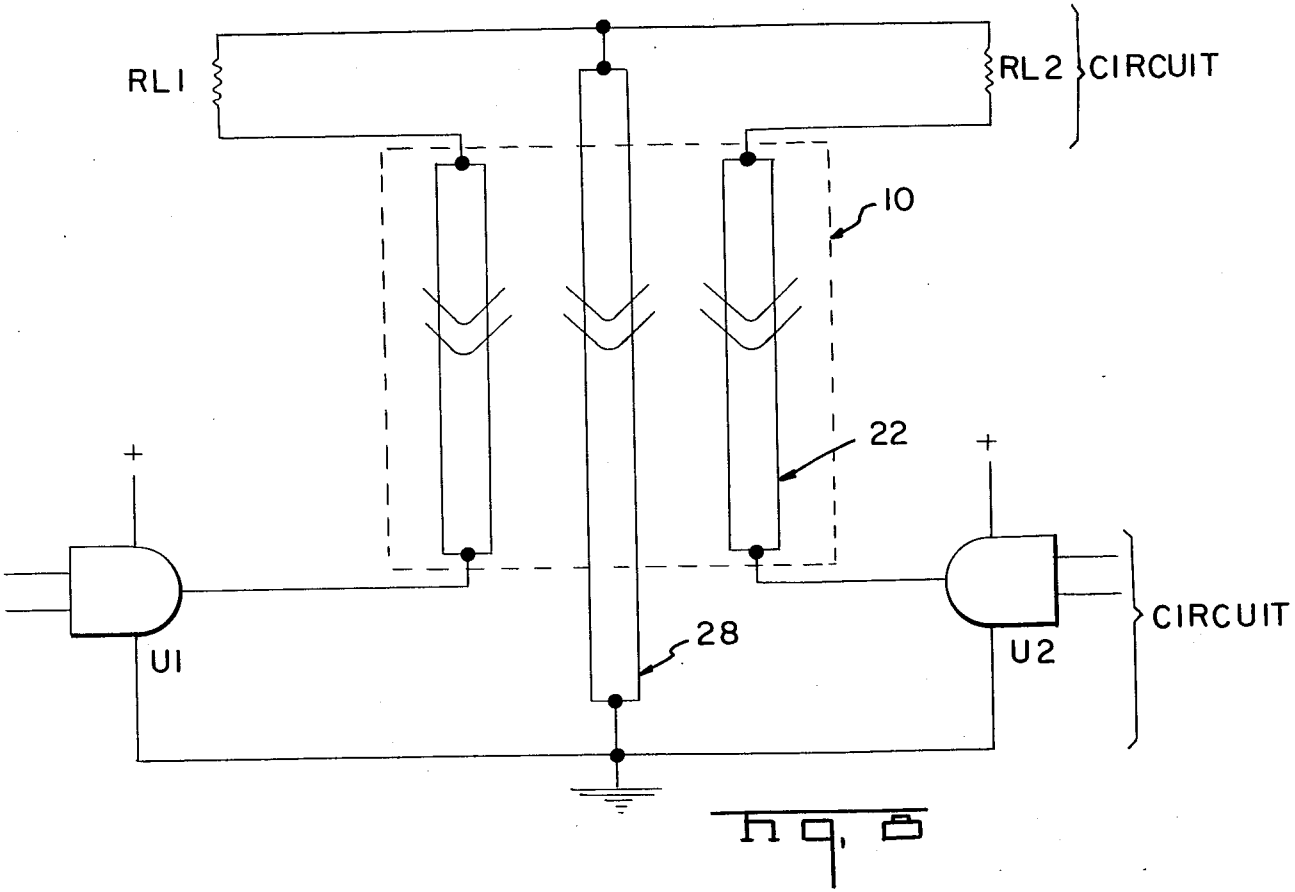

The configuration shown in FIGS. 1 through 4 would be employed to interconnect printed circuit boards disposed in parallel relationship. In order to interconnect conductive traces of angularly oriented printed circuit boards 202 and 204 as shown in FIG. 7, an upper or male connector half 206 as shown in FIGS. 5 through 7 would be employed with a lower connector half 14 of the type shown in the first embodiment. In such second or alternate embodiment, which is particularly suitable for interconnecting mother and daughter boards, the upper connector half includes a housing 208 constructed of electrically insulating material and formed of two interconnection blocks 210 and 212.

Each male bus portion 214 is located in spaced relationship between the male signal contacts 216 and 218 which are arranged in two rows generally parallel with each other. The busses include a bend or curve in a central region. Retention posts or solder tails 220 extend from the busses at the adjacent area in the plane of the busses transversely or perpendicularly with respect to the printed circuit board 204. The solder tails extend beyond the outwardly facing exterior surface 222 of the housing. Unlike the busses and terminals in the upper housing of the primary embodiment, which were linear in configuration, the bus and terminals of the second embodiment are all curved or bent in a common area 224, shown as a 90 degree bend or curve in order to accommodate the electrical and mechanical interconnection of printed circuit boards oriented at right angles with respect to each other, the conventional orientation of mother and daughter boards.

In order to accommodate printed circuit boards in non-parallel relationship and still effect the desired electrical functions occurring in the primary embodiment as described above, continuous insulative material, shown as the plastic of the housing portions, is positioned adjacent the ground bus curve between the bus and the bent terminals on the inside of the ground bus curve. Insulative material, shown as the plastic of the housing portions and an air space, is positioned adjacent the ground plane curve between the ground plane and the terminals on the outside of the ground plane curve. This configuration and electrical relationship between the terminals and the busses, functioning as a ground plane, will allow for the unaffected microstrip transmission of electrical signals where there is a change of direction since the terminals and ground plane are effectively rendered electrically parallel.

As can be seen in the drawings, particularly FIGS. 5 and 7, the rows of terminals lie in parallel, spaced first planes. The busses, including their posts or solder tails, lie in a second plane which is located between, spaced from, and parallel with, the first planes. This geometry and electrical relationship between the ground plane busses and terminals will allow for the microstrip transmission of electrical signals by each row of terminals with controlled characteristic impedance. This functional relationship between the ground plane busses and terminals exists in both the alternate and preferred embodiment. Note FIGS. 4 and 7. Although the ground plane busses and terminals bend for coupling printed circuit boards oriented at 90 degrees, an essentially constant dielectric thickness is effected and maintained by the insulating material separating the busses from the rows of terminals. This renders the busses and terminals effectively parallel and generally constantly spaced for electrical purposes in both embodiments and provides uniform characteristic impedance. The essence of maintaining the controlled impedance constant is to maintain a constant dielectric thickness between the ground plane and the terminals so that even though a right-angle bend or curve is introduced, the desired physical relationship is constant insofar as dielectric thickness and properties are concerned.

Further, in an alternate mode of operation, the electrically conductive busses 214, or 28 of the primary embodiment, could function as a mechanism for carrying powering current between traces of electrically coupled printed circuit boards. In such case, the electrically conductive busses would no longer function as a reference or ground plane for controlling the characteristic impedance of the terminals. The terminals 216 and 218, or 22 of the primary embodiment, could still be utilized as signal lines but without the precise control of impedance as attainable in the above-described mode of operation for the two embodiments of the present invention. With regard to this alternate mode of operation, note is taken that both embodiments of the present invention disclose the electrically conductive busses as being formed of a series of separate segments, located side by side within the housings. Insulative material isolates the segments, one from another. In such a configuration, some bus segments may function as reference ground planes while other bus segments may function as power busses. Selection of bus segments and segment functions within a single housing may be utilized for either or both functions to suit a particular application. Further the width of the segments and number of legs may also vary, again to suit a particular application, thereby extending the utility of the connector and the system in which it is utilized.

When the connector halves of the second embodiment are coupled as shown in FIG. 7, the upper housing 208 along with its associated male signal contacts 216 and 218 and busses 214 are all configured to couple boards 202 and 204 which are arranged at a right angle configuration with respect to each other. This is the orientation printed circuit boards normally take in a mother board-daughter board relationship. As can be seen, particularly in FIGS. 5 and 7, the busses of the male or upper connector portion 206 are configured to include a 90 degree, or right angle, curve or bend in a central region 224. The male contacts 216 and 218 are, likewise, configured with similar right angle curves or bends 226 and 228 located with their bends on opposite sides of the bend of the busses. The signal contacts 216 on the inside of the curve of the busses include solder tails 230 and 232, alternating between simple and compound bends or curves. Similarly, the solder tails 234 and 236 on the outside of the curve of the busses includes solder tails which are alternating between bends or curves. All of the solder tail portions of the signal contacts and the busses are parallel with each other as they pass through staggered rows of holes in the printed circuit boards.

The upper housing is formed of two blocks 210 and 212 which may be assembled together to support the busses and signal contacts in their proper orientation. The first block 210 is molded or otherwise formed of an electrically insulative material, shown as plastic, and includes a downwardly projecting shroud 240 positionable adjacent the lower or female connector portion 14, constructed as disclosed in the primary embodiment. This first block includes an exterior face 242 matable against the upper exterior face 70 of the female connector portion 14. Vertically disposed on the central axis of the first block are a plurality of slots 244 for receiving the busses 214. Spacers 246 separate, and electrically isolate, each bus from the adjacent busses. Downward movement of each bus into its slots is limited when the spaced horizontal edges 248 on the vertical extent of each male bus contacts against an upper edge of the blocks 250.

On opposite sides of the central slot 244 are rows of apertures 252 and 254 parallel with each other and parallel with the slot. The apertures 252 of the first row are each adapted to receive an exterior signal contact 218, exterior of the bend or curve of the bus. Each aperture is configured with an abutment surface 256 to be contacted by an offset 258 in the vertical portion of the exterior signal contact to limit downward movement of each signal contact into its aperture. Similar apertures 254 are provided in the housing for receipt of the interior signal contacts 216. This signal contacts are similarly formed with an offset 262 for contacting an abutment surface 264 for properly limiting the downward motion of the interior signal contacts into their apertures 254. The walls 268 and 270 separate the signal contacts from each other from edge to edge across the width of the housing. In addition, the walls 270 of every other slot 272 are formed to provide dovetailed slots 274 for receiving dovetailed blocks 276 of the second block. The first block is also provided with locking apertures 278 adjacent its uppermost edge for receiving posts and latches 280 and 282 projecting from the second block 212. The latches are provided with vertical locking surfaces 284 parallel with the rows of busses for being received by parallel ledges 286 in the locking apertures for limiting rearward motion of the second block with respect to the first block once the blocks are assembled. The posts and latches also assist in the proper aligning of the two blocks during assembly. The posts have no vertical locking surfaces. They separate pairs of latches which have their vertical locking surfaces facing in alternating directions to equalize the forces between the blocks. Without such alternating directions, the latches would tend to laterally shift the blocks to one side or the other with respect to each other. The dovetail blocks 276, depending from the lower face of the second block 212, within the dovetail slots 274, also assist in retaining the blocks together and preclude lateral motion of the blocks with respect to each other during operation and use.

The second block 212 is provided with central horizontal openings 288 through which the bus solder tails 220 may pass. The interior signal contacts 216, interior of the curve or bend of the busses, include both essentially straight and bent solder tails 230 and 232. The essentially straight solder tails 230 pass between the dovetail blocks 276. The curved solder tails 232 pass beneath a contoured portion 294 of the dovetail blocks 276.

The exterior or upper solder tails 234 and 236 are also alternately essentially straight and bent with the bent solder tails 236 passing above a contoured member 292 of the second block 212. The essentially straight line solder tails 234 pass directly through the upper horizontal aperture 296 of the second block whereat no such contoured pieces are located. Adjacent the interior face 298 of the second block, the upper horizontal aperture 300 includes a slot 302 for receiving the enlarged central extent 304 of the bus for proper final positioning and alignment between the blocks. The slot 32 is partially open at the top and is sufficiently large so as to allow the bent solder tails 236 to extend therethrough. The opening in the slot is not so large as to allow the enlarged central extent 304 of a bus to pass therethrough and will, therefore, secure the bus in proper position for operation and use.

With the inner signal contacts 216 and the male bus portions 214 and the outer signal contacts 218 properly placed within the first block, the second block 212 may then be slid into position with the solder tails passing through appropriate portions thereof until abutment surfaces of the second block contact corresponding abutment surfaces of the first block adjacent areas or regions 306 and 310 to thereby limit motion therebetween. At this time the dovetail blocks 276 have been received in their associated dovetail slots 274 and the posts and latches 280 and 282 have been received in the apertures 278 of the first block 210. The vertical rising or backing out of the male bus portions and signal contacts is precluded as their vertical uppermost extents contact corresponding abutment surfaces of the second block adjacent areas or regions 312, 314 and 316, The operation of the connector of the present invention can be seen and understood with reference to FIG. 8. This Figure illustrates the terminals 22, or 216 and 218 in the second embodiment, and the electrically conductive bus 28, or 214 of the second embodiment, functioning as a reference or ground plane as well as a current return line. Devices U-1 and U-2, shown as associated with one of the boards, provide signals through the circuits of the printed circuit board or boards and through the terminals and to the loads shown as RL-1 and RL-2 on their associated printed circuit board or boards. Although only two such circuits are shown, large numbers of such circuits would normally be utilized. The current output from each device flows through the terminals and circuits and returns through the ground traces and the bus.

The current output of each device U-1 and U-2 flows through the individual terminals but collectively returns through the bus. Because of the collective currents returning through the bus, it is important to lower the inductance of each bus to its minimum so that an undesirably high voltage will not be produced thereacross. When devices switch simultaneously as occurs in the disclosed embodiments, this voltage can be defined by the equation $V=L(di_1+di_2+\ldots+di_n)/dt$.

In the equation, L is a constant which depends upon the dimensions of the bus body as well as the bus solder tails. There is actually a series inductance where the bus body functions as one inductor. The solder tails at one end of the bus collectively function as another inductor. The third inductor is the opposite set of solder tails. The three inductors constitute a constant for any particular bus configuration independent of the circuit in which they are employed. The terms $di_1$, $di_2$ through $di_n$ represent the current output from each of the devices U-1, U-2, etc. whereas dt represents the simultaneous switching time for the circuit.

The plurality of current paths introduced by multiple solder tails, as well as increasing the mass of the bus bar itself, decreases the inductance of the bus bar to overcome the objection of an increasing voltage caused by the increasing change of times. In designing the busses properly as disclosed herein, with the plurality of solder tails adjacent the edges of each bus and therebetween and extending across the width of the bus, there is a lowering of the inductance of the bus with improved operation of the system, particularly in applications where faster switching is employed as required by more sophisticated circuitry.

While the present invention has been described with respect to specific embodiments thereof, it is not intended to be so limited, but it is intended to be protected broadly within the spirit and scope of the appended claims.

What is claimed is:

1. An electrical connector for use in establishing interconnections to a printed circuit board, including:

housing means of insulative material having a plurality of terminal passages therein arranged in a planar array, the housing means being formed of first and second matable portions, each first housing portion being matable with a second housing portion;

a plurality of electrical terminal means, each terminal means mounted in a respective terminal passage, each having a tail extending therefrom and constituting means for interconnection to a circuit of the printed circuit board, the terminals being formed of first and second matable portions, each first terminal portion being matable with one of the second terminal portions;

rigid elongate bus means within the housing, effectively parallel with the terminals and attachable to the printed circuit board for electrical connection to a reference plane, the bus means being formed of first and second matable portions, each first bus portion being matable with a second bus portion; and one of the housing portions being formed of two blocks with means formed in at least one of the blocks to couple and uncouple the two blocks for the receipt of said first terminal portions and said first bus portions in the one housing portion.

2. The electrical connector as set forth in claim 1 wherein the terminal portions and bus portions within the two blocks are configured for coupling printed circuit boards oriented in a non-parallel relationship with respect to each other.

3. The electrical connector as set forth in claim 2 and further including aperture means in one of the blocks and projection means in the other of the blocks for being removably received within the aperture means to assist in the coupling and uncoupling of the blocks.

4. An electrical connector as set forth in claim 2 and further including slot means in one of the blocks and additional means in the other of the blocks for being removably received within the slot means to assist in the coupling and uncoupling of the blocks.

5. An electrical connector assembly comprising mating male and female connectors for use in establishing interconnections to a printed circuit board, each connector comprising:

a housing of insulative material having a plurality of passages therein arranged in a first plane;

a plurality of electrical terminals, each terminal mounted in a respective passage whereby each terminal is located within the first plane, each terminal having a tail extending therefrom and constituting means for interconnection to a circuit of the printed circuit board;

a planar, elongate, electrically conductive ground bus mounted within a bus passage and located within a second plane effectively parallel with the first plane, the bus being attached to the housing effectively parallel with the terminals with insulative material between the bus and the terminals, the bus also being attachable to the printed circuit board for constituting a reference plane for the microstrip configured transmission of electric signals by the terminals; and bus solder tail means within the second plane formed as extensions of the bus and extending across the width of the bus constituting both the means for mounting the bus to the printed circuit board as well as the means for securing the housing to the printed circuit board, the connector assembly being characterized by a male bus in one connector and a mating female bus in the other connector, the male and female busses each being provided with a plurality of solder tails extending across the width of each bus.

6. The electrical connector assembly as set forth in claim 5 wherein the female bus includes regions adapted for movement toward and away from the second plane, with a plurality of solder tails extending across the width of the bus.

7. The electrical connector assembly as set forth in claim 6 wherein the spring means include regions adapted for movement toward and away from the second plane.

8. The electrical connector assembly as set forth in claim 7 wherein the spring means includes other regions oriented and configured to secure the female portion of the bus within a passage of the housing.

9. An electrical connector for use in establishing interconnections between printed circuit boards comprising:

a housing of insulative material having a plurality of apertures therein arranged in a first plane;

a plurality of electrical terminals for establishing electrical couplings between the printed circuit boards, each electrical terminal being mounted in a respective aperture whereby each electrical terminal is located within the first plane, each electrical terminal having tails extending therefrom and constituting means for interconnection to circuits of the printed circuit boards;

a planar, elongate, electrically conductive element attached to the housing in a second plane parallel with the first plane and electrical terminals, the electrically conductive element being attached between the printed circuit boards for constituting an additional means for establishing an electrical coupling between the printed circuit boards; and solder tails located within the second plane extending from edge to edge across the width of the electrically conductive element and constituting both the means for mounting the electrically conductive element to the printed circuit boards as well as the means for securing the housing to the printed circuit boards, characterized in that the housing, electrical terminals, and electrically conductive element are each formed of matable male and female halves.

10. The electrical connector as set forth in claim 9 wherein the solder tails are formed on both halves of the electrically conductive element.

11. The electrical connector as set forth in claim 10 wherein the female half of the electrically conductive element includes springs biased for coupling with the male half of the electrically conductive element.

12. The electrical connector as set forth in claim 11 wherein the springs of the female half of the electrically conductive element are inwardly urged and are engageable with the male half of the electrically conductive element through movement generally perpendicular with respect to the axes of the electrical terminals.

13. The electrical connector as set forth in claim 9 wherein the electrical terminals are located in two spaced parallel planes on opposite sides of the second plane.

14. An assembly for interconnecting corresponding conductive traces of printed circuit boards including:

a first connector half having a first housing formed of dielectric material with a plurality of first signal contacts retained within the first housing, the first signal contacts being positioned in two longitudinally extending parallel rows, each first signal contact having a tail extending from an outwardly facing surface of the first housing;

a second connector half intermatable with the first connector half and having a second housing formed of electric material with a plurality of second signal contacts retained in rows within the second housing and intermatable with the first signal contacts, each second signal contact having a tail extending from an outwardly facing surface of the second housing, each second contact configured so that the tail extends at an angle relative to the first contact, the first and second housings being attachable to each other at their inwardly facing surfaces whereby the tails of the first and second terminals may couple with the printed circuit boards for coupling conductive traces of respective printed circuit boards; and electrical means within the first and second housing and positioned between the rows of signal contacts and configured so that a portion of electrical means in the first housing extends at an angle relative to a portion of the electrical means in the second housing, whereby the terminals and electrical means are effectively electrically parallel between the printed circuit boards oriented at an angle.

15. The assembly as set forth in claim 14 wherein the angle is 90 degrees.

16. The assembly as set forth in claim 14 wherein the electrical means are provided with tails for electrically and mechanically coupling the assembly to the printed circuit boards.

* * * * *